United States Patent [19]

Springer

[11] 4,365,378

[45] Dec. 28, 1982

[54] CARPET AND FABRIC CLEANING MACHINE

[75] Inventor: John R. Springer, Overland Park, Kans.

[73] Assignee: Nu-Co Industries Inc., Overland Park, Kans.

[21] Appl. No.: 240,994

[22] Filed: Mar. 5, 1981

[51] Int. Cl.[3] ..... A47L 11/14; B24B 29/00

[52] U.S. Cl. ..... 15/98; 15/230; 15/230.17; 51/358

[58] Field of Search ..... 15/230.1, 230, 230.14, 15/230.15, 230.16, 230.17, 230.18, 230.19, 97 R, 98; 51/358

[56] References Cited

U.S. PATENT DOCUMENTS

| | | | |
|---|---|---|---|
| 1,689,166 | 10/1928 | Varner | 15/98 |
| 2,008,260 | 7/1935 | Reineman | 15/230.17 X |
| 2,263,883 | 11/1941 | Livermont | 15/230.19 |
| 3,448,476 | 6/1969 | Zaccone | 15/97 R |
| 3,527,001 | 9/1970 | Kleemeier et al. | 15/230.17 X |
| 3,823,516 | 7/1974 | Christian | 51/358 |
| 4,069,538 | 1/1978 | Fallen | 15/230.17 |

FOREIGN PATENT DOCUMENTS

| | | | |
|---|---|---|---|
| 612300 | 4/1935 | Fed. Rep. of Germany | 15/98 |

*Primary Examiner*—Edward L. Roberts

*Attorney, Agent, or Firm*—Schmidt, Johnson, Hovey & Williams

[57] ABSTRACT

An improved, low cost floor cleaning device usable for cleaning carpets, upholstered furniture, walls, autos or hard surface flooring is provided which includes cooperating structure for easy pad installation and removal, and for positive pad connection to the device during use. The floor cleaner includes a high torque gear motor operatively coupled to a circular, rotatable disk having a series of peripheral depending teeth. The disk teeth are adapted to fit into and engage structure-defining interstices or zones associated with a floor-engaging pad, so that a positive mechanical interlock is provided. In addition, an upstanding, inwardly biased collar is secured to the pad for engaging or entrapping the disk and thus ensuring a secure connection between the disk and pad. In preferred forms, the device includes an elongated handle having handholds both at the uppermost end of the handle and intermediate the ends thereof; in this fashion the user can exert considerable downwardly directed force against the pad to facilitate floor cleaning.

4 Claims, 13 Drawing Figures

Fig. 5.
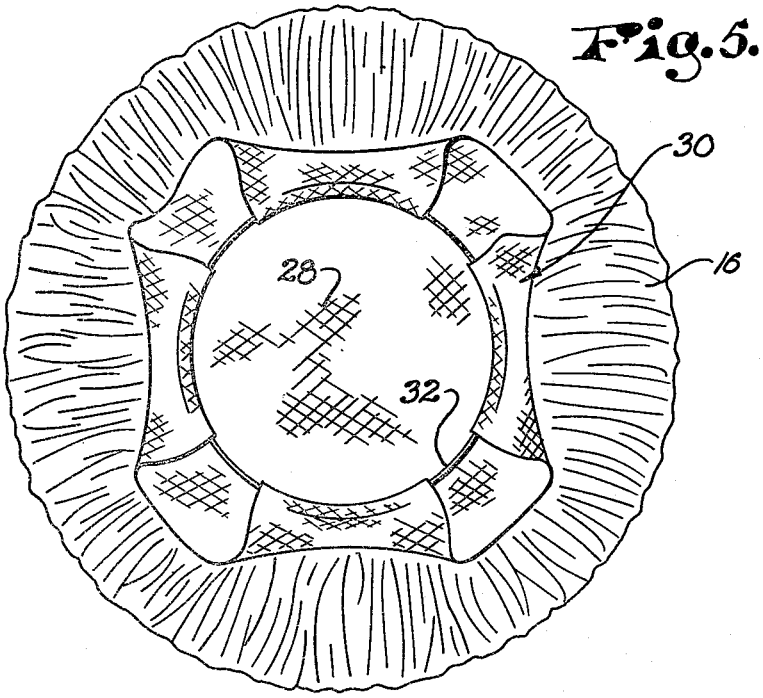
Fig. 7.
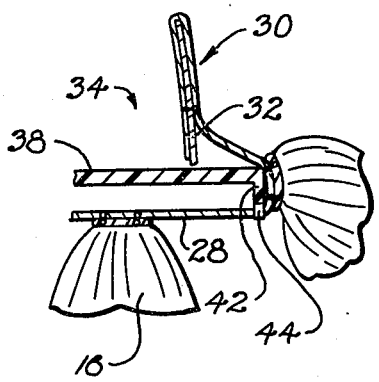
Fig. 8.
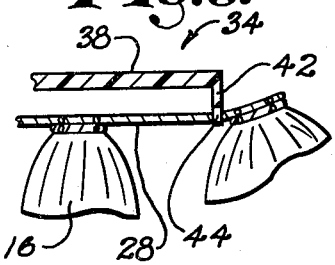
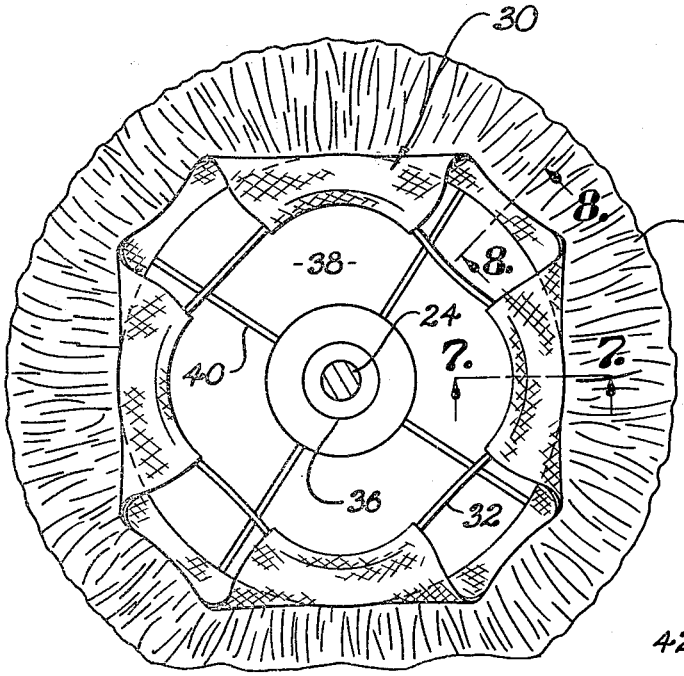
Fig. 6.
Fig. 9.
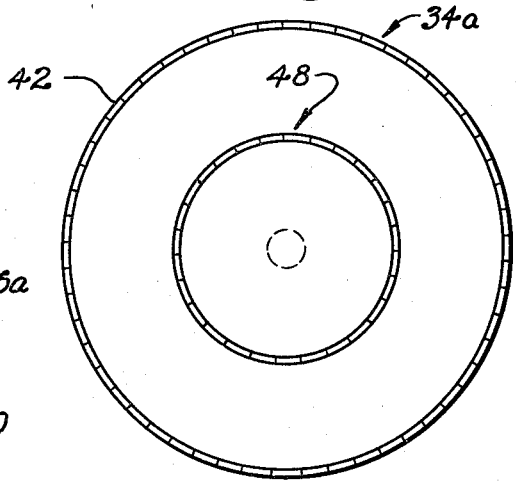
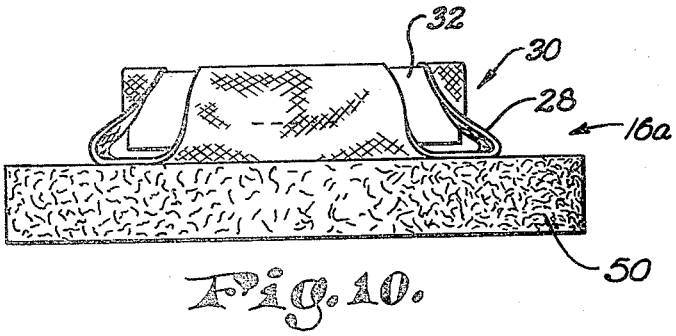
Fig. 10.

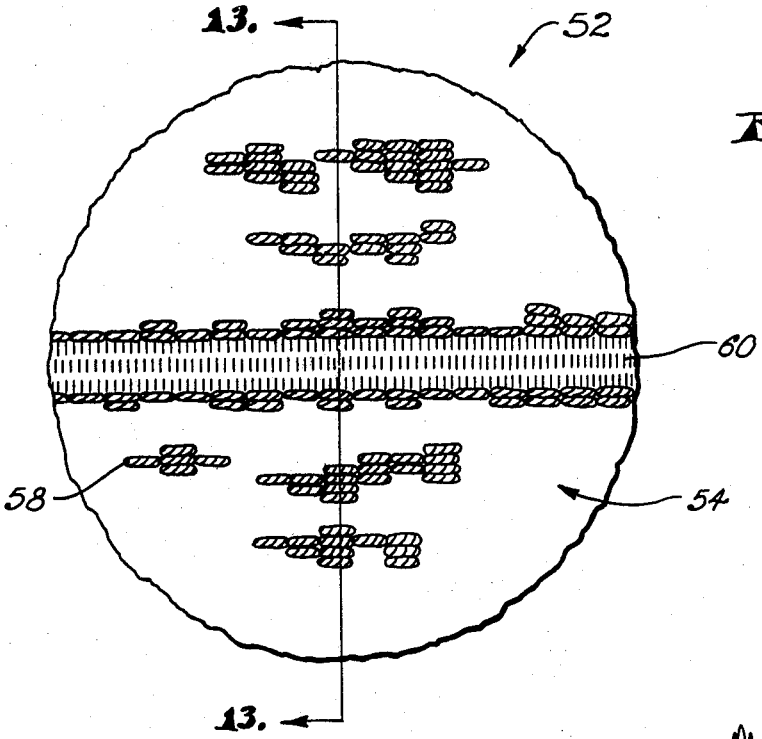
Fig. 11.
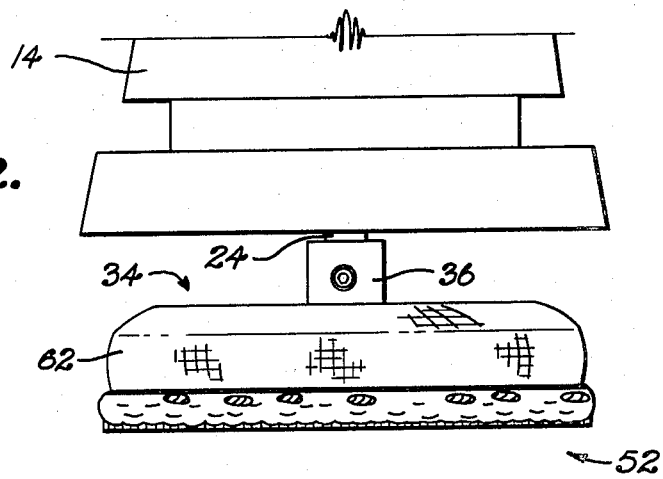
Fig. 12.
Fig. 13.
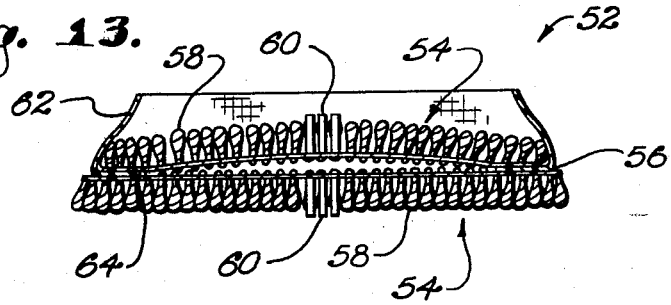

CARPET AND FABRIC CLEANING MACHINE

BACKGROUND OF THE INVENTION

1. Field of the Invention

The present invention is concerned with an improved floor cleaning device of the type adapted to employ changeable floor-engaging pads for use in cleaning carpets, upholstered furniture, walls, autos or other flooring. More particularly, it is concerned with such a device wherein pad connection is assured by provision of a rotatable, toothed disk in conjunction with interstitial structure associated with the pad and presenting teeth-receiving openings therethrough.

2. Description of the Prior Art

Rug or floor cleaners employed by professionals are, generally speaking, rather large and unwieldy, and are therefore difficult to handle and manipulate by the average homeowner. Such units include a large, high torque motor which serves to rotate a floor-engaging pad. A handle is normally secured to the motor housing, and extends upwardly to a convenient height for use. In certain units of this type, no positive interconnection is provided between the cleaning pad and the motorized unit; rather, the weight of the motor is employed for effectively holding the pad in place during use.

Floor cleaning devices typically used by the average homeowner are to a certain extent similar to their commercial counterparts, but differ in that they are much smaller and hence lighter in weight. While this greatly facilitates manipulation and use thereof, the very lack of significant weight and bulk makes it necessary to provide some sort of positive connection between the floor-engaging pad and the device itself. At the same time, the pad must be readily removable and changeable, else the convenience sought to be gained with the smaller cleaning device is in large measure lost.

Therefore, there is a need in the art for a relatively small size floor and upholstery cleaning device having improved structure for coupling a floor-engaging pad thereto, so that the homeowner can make use of the device without undue difficulty.

SUMMARY OF THE INVENTION

The present invention overcomes the problems mentioned above, and provides an improved floor cleaning device which is light in weight, easy to use, and with an easily removable yet secure pad coupled thereto. Generally speaking, the device of the invention includes a substantially flat, floor-engaging pad along with motive means such as a gear motor for rotating the pad. Means are also provided for operatively coupling the motive means and pad, and includes structure defining a plurality of openings or zones adjacent the upper surface of the pad. The coupling means further includes a rotatable disk secured to the motive means and having a series of depending teeth received in associated openings or zones. Finally, an upstanding, inwardly biased collar member preferably in the form of a strip of elastic is operatively connected to the pad and serves to resiliently engage and essentially entrap the disk.

Thus, the disk teeth and teeth-receiving zones, along with the collar member, serve to cooperatively secure the pad against accidental dislodgement during use of the floor cleaning device, while at the same time permitting easy pad changeover.

BRIEF DESCRIPTION OF THE DRAWINGS

FIG. 5 is a plan view of a pad in accordance with the invention;

FIG. 6 is a sectional view illustrating a pad in accordance with the invention operatively secured to the rotatable, toothed disk;

FIG. 7 is a sectional view taken along line 7—7 of FIG. 6;

FIG. 8 is a sectional view taken along line 8—8 of FIG. 6;

FIG. 9 is a bottom view of another pad-engaging disk in accordance with the invention, having two series of circularly arranged, dependent teeth;

FIG. 10 is an elevational view of another pad in accordance with the invention, which presents an abrasive floor cleaning surface;

FIG. 11 is a view illustrating the floor-engaging underside of a preferred pad in accordance with the invention;

FIG. 12 is a fragmentary side view of the floor cleaning device of FIGS. 1–3, but equipped with the pad of FIG. 11; and FIG. 13 is a sectional view taken along line 13—13 of FIG. 11.

DESCRIPTION OF THE PREFERRED EMBODIMENTS

Figure 1:
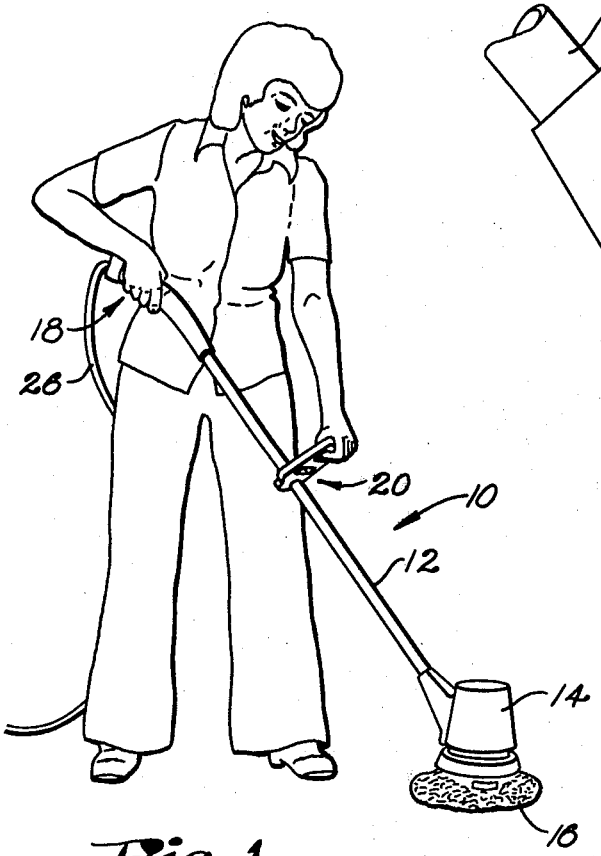
FIG. 1 is an elevational view of an individual using a floor cleaning device in accordance with the present invention.
Figure 2:
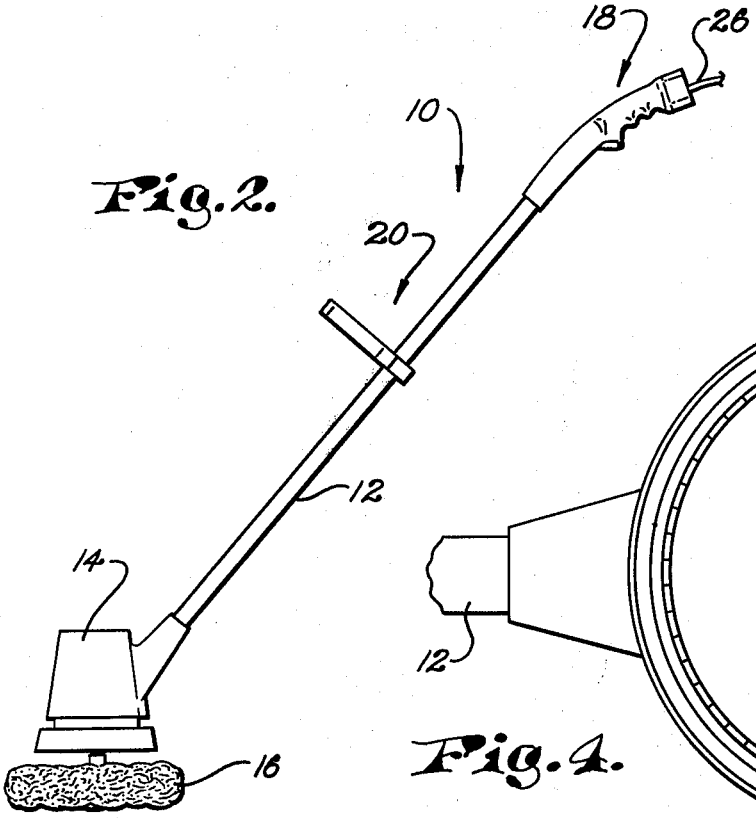
FIG. 2 is a side elevational view of the device depicted in FIG. 1.
Figure 4:
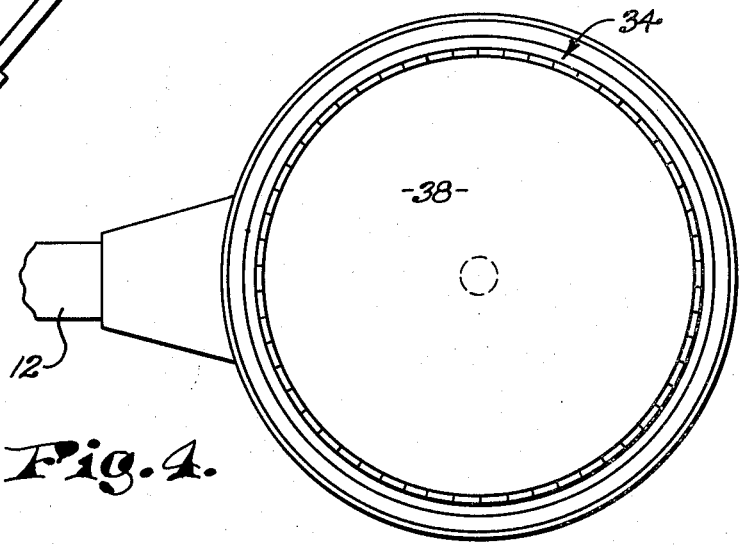
FIG. 4 is a bottom view of the structure illustrated in FIG. 3.

Turning now to the drawings, a floor cleaning device 10 is illustrated in FIGS. 1 and 2. Broadly speaking, the device 10 includes an elongated operating handle 12 secured to a somewhat frustoconical housing 14, and a floor-engaging pad 16 secured to the underside of the housing. As illustrated, the handle 12 includes a pair of handholds 18 and 20, with handle 18 being located at the uppermost end of the handle 12, and handhold 20 being located intermediate the ends thereof.

Figure 3:
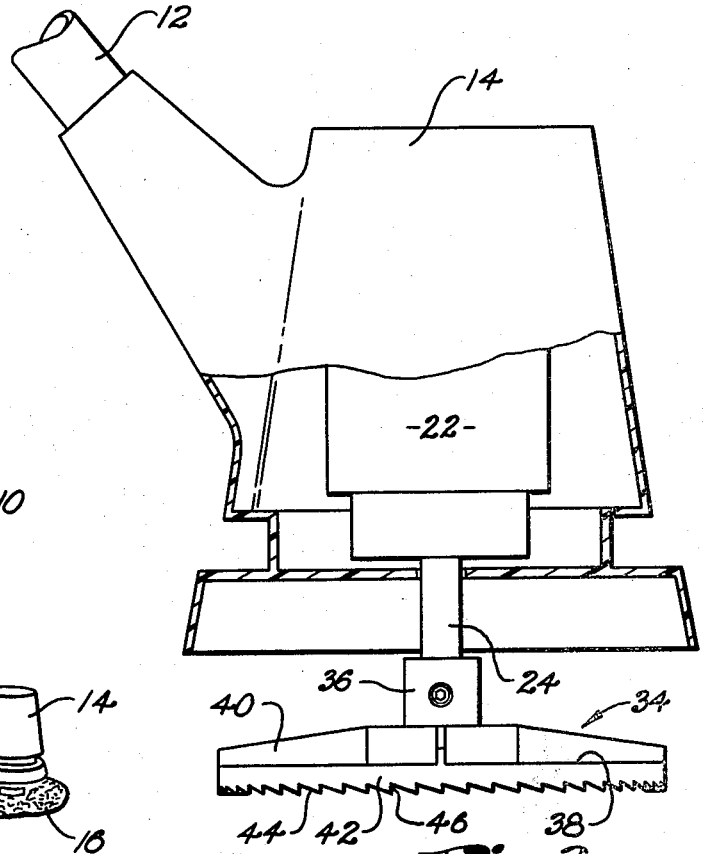
FIG. 3 is an enlarged, fragmentary view in partial vertical section illustrating the motor, housing and pad-engaging disk of the device.

A high torque gear motor 22 (see FIG. 3) is located within housing 14, and has a depending, elongated, axially rotatable output drive shaft 24 secured thereto. Motor 22 is electrically operated, and power is supplied thereto by means of an electrical cord 26 which extends through handhold 18 and down the length of handle 12.

Pad 16 (see FIG. 5) is of generally flat configuration and is of yarn pile construction. A section of open mesh netting 28 is secured by sewing to the upper surface of pad 16 at the central region thereof. The netting presents a plurality of openings therethrough, which are important for purposes to be explained. In addition, the outer periphery of the netting section 28 extends upwardly from pad 16 to present a collar portion 30. A strip of elastic material 32 is secured to the collar portion 30 as illustrated, and serves to inwardly and resiliently bias the collar portion 30.

A rotatable synthetic resin disk 34 is operatively secured to the lowermost end of shaft 24, and serves, along with netting section 28 and the elastic strip 32, to couple the pad 16 to the motor 22. In more detail, the disk 34 includes a central hub portion 36, and a circular, laterally extending plate section 38. A series of circumferentially spaced, outwardly extending reinforcing ribs 40 are secured to the uppermost face of plate section 38. The disk further includes a series of depending, circularly arranged, peripheral teeth 42 which are sized to be received within the openings of the netting section 28. In this manner, a positive mechanical interlock between the disk 34 and pad 16 is assured. It will be further observed in this respect that the teeth 42 each include an oblique surface 44 and an upright surface 46; and that the direction of rotation of disk 34 is such that the respective upright tooth surfaces 44 engage the netting section 28 for positive transmission of rotary motion. In the use of device 10 with pad 16, the latter is installed simply by expanding the elastic strip 32 to a point where it clears the outer periphery of disk 34. At this point the pad is pressed against the underside of the disk such that the teeth 42 are received within associated openings in the netting section 28. The elastic strip 32 is then released, so that the collar portion 30 of the netting section is biased inwardly, thus serving to effectively entrap the disk between the elastic strip 32 and the netting section 28. Hence, the strip 32 and associated collar portion 30, in conjunction with the teeth 42 received within the openings in netting section 28, securely fasten pad 16 and prevent its inadvertent dislodgement.

Use of device 10 is further facilitated by provision of the spaced handholds 18 and 20. Specifically, by means of this arrangement, the user can apply considerable downwardly directed force to pad 16, to greatly facilitate effective cleaning.

FIG. 9 illustrates a modified pad-engaging disk 34*a*. The disk 34*a* is identical with disk 34 save for provision of a second, inner series of teeth 48. The teeth 48 are identical in configuration with the outermost teeth 42, and are provided to give a still more secure fastening of the pad 16.

FIG. 10 depicts another type of pad 16*a*. In this instance, pad 16*a* includes the netting section 28 secured to the upper surface thereof, the collar portion 30, and elastic strip 32. However, the floor-engaging portion 50 of pad 16*a* presents an abrasive surface for cleaning of hard floorings. Advantageously, the portion 50 is fabricated from material such as described in U.S. Pat. No. 2,958,593.

The most preferred pad, however, is illustrated in FIGS. 11–13. In particular, the pad 52 includes a pair of opposed, circular, face-to-face yarn pile halves 54 which are peripherally stitched together as at 56. Each half 54 includes a plurality of yarn loops 58 and an elongated, central strip 60 of more rigid, abrasive material such as so-called "Astroturf." This strip presents a more abrasive cleaning surface to facilitate use of the pad 52. In addition, the overall pad includes an upstanding collar member 62 formed of a strip of elastic. The lowermost end 64 of the collar member is located between the halves 54 of the pad 52, and is sewn in place between the latter.

The weave of at least the uppermost half 54 is such that, when it is pressed against the depending teeth 42 of the disk 34, the material yields and thus presents the desirable teeth-receiving zones or openings therethrough. Thus, although the halves 54 are not, upon visual inspection, characterized by a pattern of openings therethrough, such are effectively formed when the pad is installed on the rotatable disk 34. It will further be observed in this respect (see FIG. 12) that the collar member 62 is inwardly biased and serves to engage and envelop the disk much in the manner of collar portion 30 described above.

I claim:

1. A lightweight machine for cleaning generally flat surfaces including:

a portable housing;

means operably connected to said housing for facilitating manual manipulation of said cleaning machine;

a generally flat cleansing pad for engaging said surfaces;

motive means operably mounted to said housing and capable of delivering a high rotational torque;

means operably coupling said motive means and said pad comprising a disc operably secured to said motive means for rotation by the latter, a plurality of circularly arranged relatively closely adjacent, equidistantly spaced teeth depending from said disc and integral therewith, each of said teeth having a generally flat upright surface and an oblique surface, each of said flat surfaces lying in an imaginary plane radial of the disc and facing the direction of rotation of said disc, said oblique surfaces interconnecting respective adjacent upright flat surfaces;

a section of open mesh netting operably connected to and supporting said pad, said teeth of the disc each being of a size permitting a significant portion thereof to be received within respective associated proximal openings of said mesh netting with the flat surface thereof variably engaging the netting, the teeth being located adjacent the perimeter of the disc and engaging the netting along a series of closely spaced points arranged in a circular pattern affording a positive mechanical interlocking of the netting and thereby the pad to the disc during use of the machine.

2. The cleaning machine as set forth in claim 1, further including an inwardly biased resilient collar operably secured to and extending upwardly from said pad for resiliently engaging said disc.

3. The cleaning machine as in claim 1, said motive means comprising a high torque gear motor.

4. The cleaning machine as in claim 1, said teeth being arranged in first and second concentric, annular, net engaging rows depending from said disc.

* * * * *